US009165702B2

(12) United States Patent
Hagerty

(10) Patent No.: US 9,165,702 B2
(45) Date of Patent: Oct. 20, 2015

(54) THERMALLY-PROTECTED VARISTOR

(76) Inventor: James P. Hagerty, Sonoma, CA (US)

( * ) Notice: Subject to any disclaimer, the term of this patent is extended or adjusted under 35 U.S.C. 154(b) by 625 days.

(21) Appl. No.: 13/414,462

(22) Filed: Mar. 7, 2012

(65) Prior Publication Data

US 2013/0038976 A1 Feb. 14, 2013

Related U.S. Application Data

(60) Provisional application No. 61/449,999, filed on Mar. 7, 2011.

(51) Int. Cl.

| | |
|---|---|
| ***H01H 37/76*** | (2006.01) |
| ***H02H 9/06*** | (2006.01) |
| ***H01C 7/12*** | (2006.01) |
| *H01H 37/08* | (2006.01) |

(52) U.S. Cl.

CPC ..... *H01C 7/126* (2013.01); *H01H 37/08* (2013.01); *H01H 2037/762* (2013.01)

(58) Field of Classification Search

CPC ... H01C 7/126; H01H 2037/762; H01H 37/08
USPC ..... 337/5, 6, 142, 148, 405, 406, 79, 206, 337/186, 412; 361/56, 103, 104, 118, 127; 29/619; 338/21, 225 SD, 22 R
See application file for complete search history.

(56) References Cited

U.S. PATENT DOCUMENTS

| | | | | |
|---|---|---|---|---|
| 3,638,083 | A * | 1/1972 | Dornfeld et al. | 361/321.1 |
| 3,903,494 | A * | 9/1975 | May | 338/20 |
| 4,107,759 | A * | 8/1978 | Shirn et al. | 361/275.4 |
| 4,107,762 | A * | 8/1978 | Shirn et al. | 361/534 |
| 4,212,045 | A * | 7/1980 | Martzloff | 361/127 |
| 4,288,833 | A * | 9/1981 | Howell | 361/124 |
| 4,538,347 | A * | 9/1985 | Palilla et al. | 29/619 |
| 4,975,674 | A * | 12/1990 | Sumiyoshi et al. | 338/21 |
| 5,315,474 | A * | 5/1994 | Kuriyama | 361/534 |
| 5,363,272 | A * | 11/1994 | Tanaka et al. | 361/534 |
| 5,708,553 | A * | 1/1998 | Hung | 361/103 |
| 5,781,394 | A * | 7/1998 | Lorenz et al. | 361/124 |
| 5,901,027 | A * | 5/1999 | Ziegler et al. | 361/124 |
| 5,982,597 | A * | 11/1999 | Webb | 361/103 |
| 6,094,128 | A * | 7/2000 | Bennett et al. | 338/21 |
| 6,204,746 | B1 * | 3/2001 | Kane et al. | 337/32 |
| 6,211,770 | B1 * | 4/2001 | Coyle | 338/21 |
| 6,252,488 | B1 * | 6/2001 | Ziegler et al. | 337/5 |

(Continued)

FOREIGN PATENT DOCUMENTS

| | | | | |
|---|---|---|---|---|
| EP | 2511915 | A1 * | 10/2012 | H01H 85/36 |

*Primary Examiner* — Anatoly Vortman
(74) *Attorney, Agent, or Firm* — Patterson Thuente Pedersen, P.A.

(57) ABSTRACT

A thermally-protected varistor (TPV) device that includes a voltage-sensitive body; a first conductive lead frame adjacent the voltage-sensitive body; a second conductive lead frame adjacent the voltage-sensitive body and including a raised pad; a first conducting terminal including an end portion for contacting the raised pad when the TPV device is in a first, conducting position; a fusible material releasably connecting the end portion to the raised pad of the second conductive lead frame when the TPV device is in a first, conducting position; and a biasing element biasing the end portion such that the end portion of the first conducting terminal is configured to move away from the raised pad of the second lead frame when the temperature-sensitive fusible material releases the end portion of the first conducting terminal from the raised pad in response to heat generated by the voltage-sensitive body.

11 Claims, 8 Drawing Sheets

(56) References Cited

U.S. PATENT DOCUMENTS

| | | | | |
|---|---|---|---|---|
| 6,307,462 | B2 * | 10/2001 | McLoughlin | 338/21 |
| 6,430,019 | B1 * | 8/2002 | Martenson et al. | 361/124 |
| 6,636,403 | B2 * | 10/2003 | McLoughlin et al. | 361/103 |
| 7,375,943 | B2 * | 5/2008 | Lu | 361/126 |
| 7,453,681 | B2 * | 11/2008 | Ho | 361/127 |
| 7,477,503 | B2 * | 1/2009 | Aszmus | 361/124 |
| 7,483,252 | B2 * | 1/2009 | de Palma et al. | 361/127 |
| 7,728,709 | B2 * | 6/2010 | Grunbichler et al. | 337/4 |
| 7,741,946 | B2 * | 6/2010 | Ho | 337/5 |
| 7,839,257 | B2 * | 11/2010 | Cernicka | 337/206 |
| 8,031,456 | B2 * | 10/2011 | Wang | 361/118 |
| 8,477,469 | B2 * | 7/2013 | Depping et al. | 361/127 |
| 2007/0217111 | A1 * | 9/2007 | Tseng | 361/118 |

* cited by examiner

THERMALLY-PROTECTED VARISTOR

RELATED APPLICATION

The present application claims the benefit of U.S. Provisional Application No. 61/449,999 filed Mar. 7, 2011, which is incorporated herein in its entirety by reference.

FIELD OF THE INVENTION

The claimed invention relates to the protection of electrical and electronic circuits and equipment from power surges. Specifically, the claimed invention is directed to a thermally-protected varistor having a thermally actuated disconnect.

BACKGROUND OF THE INVENTION

Metal oxide varistors (MOVs) are common electrical components typically used to protect electrical circuits and equipment from high voltage transients. MOV's are highly non-linear devices whose characteristics result from the double Schottky barrier formed across the grain boundaries formed during the sintering process. The polycrystalline structure is primarily zinc oxide, but also has small additions of $Bi_2O_3$, $Sb_2O_3$, $SiO_2$ and other oxide constituents. The number of grain boundaries between conductive plates and the cocktail of oxides used in the formulation of the MOV determine the threshold at which an MOV begins to conduct. MOV's are placed in parallel with the systems to be protected and are therefore subject to constant electrical stress.

Further, MOV's are subjected to periodic transient voltages and overvoltage conditions which apply further electrical stress. As a result of these stresses MOV's tend to degrade over time resulting in higher leakage current. At the end of their electrical lives, MOV's tend to fail catastrophically. End-of-life failures come in various forms. Failure due to fragmentation caused by excessive transient voltage is one type of end-of-life failure. Another failure type is thermal runaway caused by either degradation of the MOV and/or a sustained abnormal overvoltage condition. A thermal disconnect is used to open the device in the event of sustained overvoltage or thermal runaway due in part to the aforementioned electrical stresses noted above. It is desirable to have the thermal disconnect mechanism in very close proximity to the MOV disk so that thermal response time is as fast as possible. Therefore the purpose of a thermal disconnect MOV is to provide for relatively benign failure when subjected to conditions leading to thermal runaway.

Although thermally protected varistors are presently available, the currently available thermal disconnect varistors comprise complicated assemblies and are costly to manufacture. A drawback of known approaches of thermally protected varistors is that they are one-time use components that must be replaced once the thermal disconnect has been triggered. As the thermal disconnect is typically enclosed in a casing, an individual maintaining the equipment may be unable to easily determine when the thermal disconnect has been triggered and needs to be replaced.

Thus, there presently exists a need for an efficiently-constructed varistor for protecting sensitive electrical circuits and equipment from abnormal overvoltage transients that can be easily maintained and serviced.

SUMMARY OF THE INVENTION

In an embodiment, the claimed invention comprises a thermally-protected varistor (TPV) device. The TPV device comprises a voltage-sensitive body including a first surface and a second surface, the voltage-sensitive body comprising a material that generates heat in response to a voltage potential across the voltage-sensitive body; a first conductive lead frame adjacent the first surface of the voltage-sensitive body, the first conductive lead frame including a first external end adapted to be electrically connected to an external electrical circuit; a second conductive lead frame including a first surface and a second surface, the first surface adjacent the second surface of the voltage-sensitive body, the second conductive lead frame including a raised pad projecting outwardly and away from the second surface of the second lead frame; a first conducting terminal including a terminal end for connecting to the external electrical circuit, and an end portion for contacting the raised pad of the second conductive lead frame when the TPV device is in a first, conducting position; a temperature-sensitive fusible material releasably connecting the end portion of the first conducting terminal to the raised pad of the second conductive lead frame when the TPV device is in a first, conducting position; and a biasing element biasing the end portion of the first conducting terminal such that the end portion of the first conducting terminal is configured to move away from the raised pad of the second lead frame when the temperature-sensitive fusible material releases the end portion of the first conducting terminal from the raised pad in response to heat generated by the voltage potential, such that the TPV is in a second, non-conducting position.

In another embodiment, the claimed invention comprises a method of thermally protecting an electrical circuit using a thermally-protected varistor device in electrical connection with the electrical circuit. The method comprises securing a varistor assembly having a varistor body and a conductive lead frame to a non-conductive frame of a thermally-protected varistor device such that a raised pad of the lead frame projects through an opening in the non-conductive frame; releasably connecting an end portion of a first conducting terminal to the raised pad using a temperature-sensitive, fusible material; and biasing the end portion of the first conducting terminal.

The above summary of the various representative embodiments of the invention is not intended to describe each illustrated embodiment or every implementation of the invention. Rather, the embodiments are chosen and described so that others skilled in the art can appreciate and understand the principles and practices of the invention. The figures in the detailed description that follow more particularly exemplify these embodiments.

BRIEF DESCRIPTION OF THE DRAWINGS

The invention can be completely understood in consideration of the following detailed description of various embodiments of the invention in connection with the accompanying drawings, in which.

Figure 1:
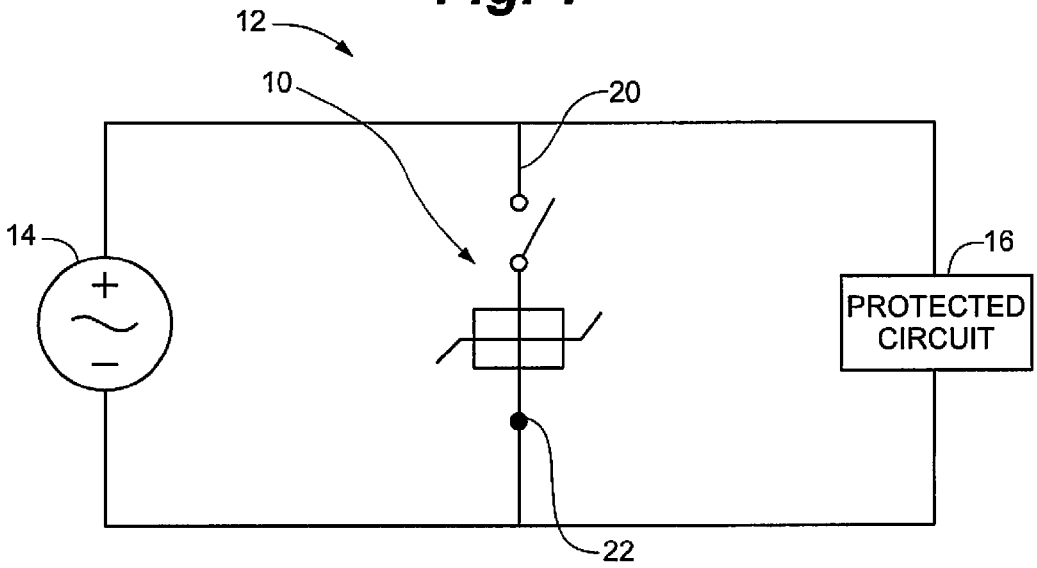
FIG. 1 is a schematic view of a representative electrical circuit.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention as defined by the appended claims.

DETAILED DESCRIPTION OF THE DRAWINGS

As shown in FIG. 1, the claimed invention is directed to a thermally-protected varistor (TPV) device 10 for use with an electrical circuit 12. The simplified electrical circuit 12 generally comprises TPV 10, power source 14, and protected electrical circuit or equipment 16. As will be understood by those skilled in the art, during normal operation, TPV device 10, positioned in parallel between a first terminal of power supply 14 and protected circuit 16, is in a closed, or conducting, position, and protected circuit 16 is powered by power supply 14. As will be described below, in an overvoltage situation, TPV 10 opens (as depicted). The electrical circuit 12 described herein is not intended to be limiting, but merely provides an illustrative example of a general electrical circuit for more clearly explaining the claimed invention.

Figure 2:
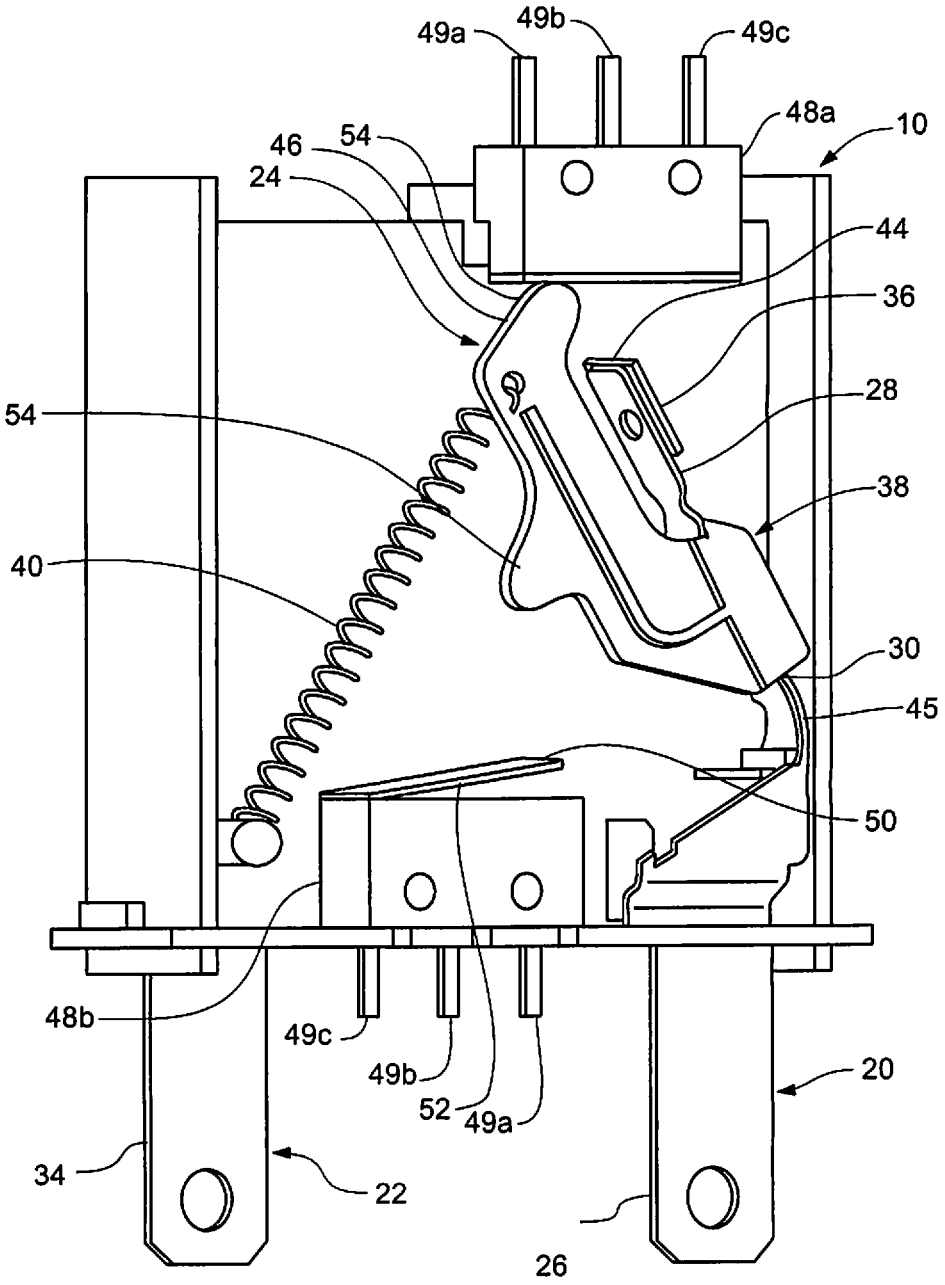
FIG. 2 is a perspective view of a thermally-protected varistor (TPV) device according to an embodiment of the claimed invention.
Figure 3:
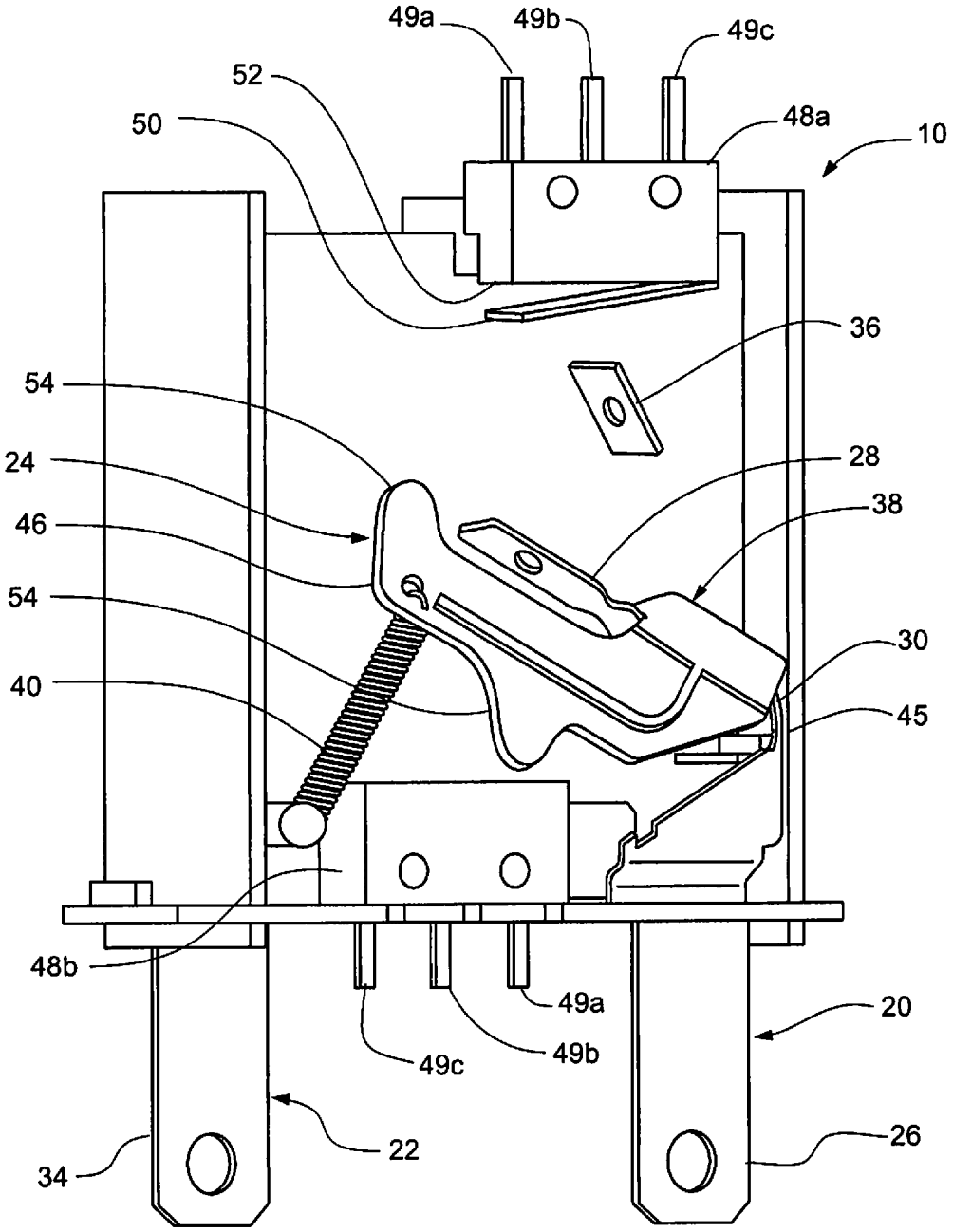
FIG. 3 is a perspective view of the TPV device of FIG. 2 after a sustained overvoltage event.
Figure 4A:
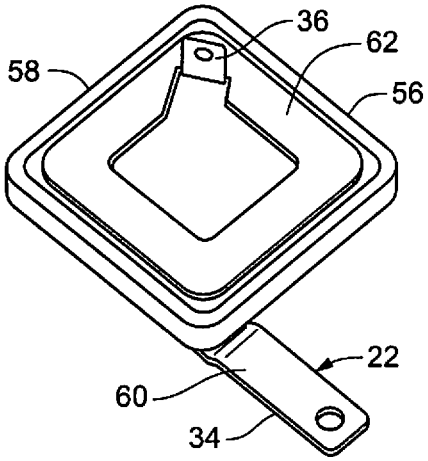
FIG. 4A is a perspective view of an MOV for a thermally-protected varistor device according to an embodiment of the claimed invention.
Figure 4B:
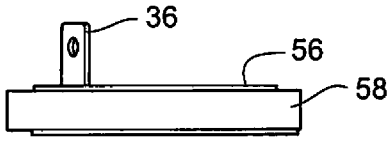
FIG. 4B is a top view of the MOV assembly depicted in FIG. 4A.
Figure 4C:
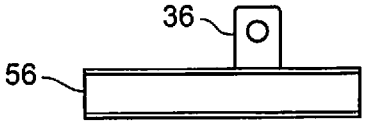
FIG. 4C is a bottom view of the MOV depicted in FIG. 4A.
Figure 4D:
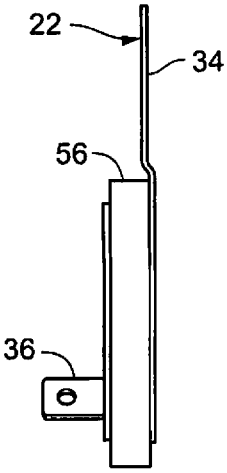
FIG. 4D is a side view of the MOV depicted in FIG. 4A.
Figure 4E:
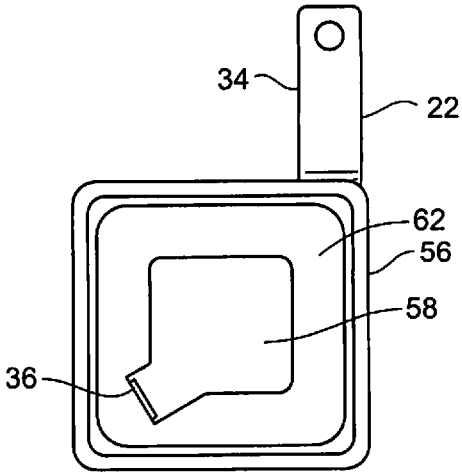
FIG. 4E is a frontal view of the MOV depicted in FIG. 4A.

As depicted in FIGS. 2-3, TPV 10, according to an embodiment of the claimed invention, comprises first conducting terminal 20, second conducting terminal 22 and biasing assembly 24. First conducting terminal 20 further comprises an external end 26 and an internal end 28 defining a biasing portion 30. Similarly, the second conducting terminal 22 further comprises an external end 34, an internal end 36 and a MOV assembly 56 comprising the external end 34 and the internal end 36. The biasing assembly 24 further comprises an arm 38 and a spring 40. The TPV 10 can further comprise an enclosure 42 for containing the components.

Referring also to FIGS. 4A-4E, MOV assembly 56 according to an embodiment of the claimed invention is depicted. MOV assembly 56 includes MOV body 58, first lead frame 60 and second lead frame 62. First lead frame 60 is adjacent a first surface of MOV body 58, while second lead frame 62 is adjacent a second and opposite surface of MOV body 58. First lead frame 60 comprises second conducting terminal 22 with external end 34. Second lead frame 62 comprises internal end 36. The second conducting terminal 22 extends outwardly and away from MOV body 58 such that the tip of the internal end 36 extends outwardly from the MOV assembly 56 at an angle perpendicular to a plane formed by the second surface of MOV body 58. The MOV assembly 56 is also adapted to support the other components of TPV 10 and engage the enclosure 42 covering the components. The MOV body 58 may comprise conventional metal oxide compounds adapted to have high resistivity at low voltages and have low resistivity in high voltage surges.

As shown in FIG. 2, the biasing portion 30 is positionable in a first position in which the internal end 28 of the first terminal 20 is in contact with the internal end 36 of the second terminal 22 so as to define a continuous thermal and electrical conductive path between the external end 26 of the first terminal 20 and the external end 34 of the second terminal 22. In this configuration, TPV device 10 further comprises a thermally sensitive material 44 disposed around and between the contact point between internal ends 28, 36 to maintain the connection between the terminals 20, 22. In an embodiment, thermally sensitive material 44 comprises a metallic solder material. The thermally sensitive material 44 is a conductive material adapted to be solid state until a current exceeding a predetermined voltage is passed through the path defined by the terminals 20, 22 and the MOV assembly 56 causing an increase in the temperature. Once the temperature exceeds a predetermined threshold, the thermally sensitive material 44 is adapted to transition into a liquid state allowing separation of the terminals 20, 22.

As shown in FIG. 3, the biasing portion 30 is positionable in a second position in which the internal end 28 of the first terminal 20 is separated by the internal end 36 of the second terminal 22 breaking the circuit defined by the TPV device 10. The arm 38 is affixed to the biasing portion 30 such that the arm 38 extends generally outwardly from the internal end 28 of the first terminal 20. The spring 40 is affixed to the arm 38 and anchored to the enclosure 42. When the biasing portion 30 is positioned in the first position, the spring 40 is stretched, applying tensile force on the internal end 28 of the first terminal 20 biasing the internal end 28 toward the second position. According to an embodiment of the claimed invention, the internal end 28 of the first terminal 20 can define a reduced thickness portion 45 to allow the internal end 28 to more easily transition between the first and second positions. As previously discussed, the thermally sensitive material 44 maintains the internal end 28 of the first terminal 20 in the first position until an overvoltage surge exceeding the rating of the MOV assembly 56 occurs. Essentially, the spring 40 is cocking the biasing portion 30 such that as soon as the overvoltage surge occurs causing the thermally sensitive material 44 to transition into a liquid state, the biasing portion 30 will move into the second position and break the circuit.

According to an embodiment of the claimed invention, the arm 38 can further comprise a parallel portion 46 running parallel to internal end 28 of the first terminal 20, such that the tip of the parallel portion 46 is proximate to the end of the internal end 28. In this configuration, the spring 40 is attached to the arm 38 at the tip of the parallel portion 46 to provide the maximum tensile force to the biasing portion 30 without interfering with the connection between terminals 20, 22. According to an embodiment of the claimed invention, the arm 38 comprises a non-conducting material including, but not limited to, a plastic material so as to prevent shorting or arcing between the spring 40, either terminal 20, 22 and the MOV assembly 56.

As shown in FIGS. 2-3, the TPV device 10 further comprises two switches 48, top switch 48*a* and bottom switch 48*b*. Each switch 48*a* and *b* includes a lever 50 and an actuator 52. Each switch 48 also includes multiple electrical contacts, which in an embodiment, includes three electrical contacts 49*a*, 49*b*, and 49*c*. In embodiment, contacts 49*a* and 49*b* may be in electrical contact with one another in a first switch position, and contacts 49*b* and 49*c* may be in electrical contact in a second switch position.

In operation, the lever 50 of each sensor 48 is positioned to depress the actuator 52 when a pushing force is applied to the lever 50. Top switch 48*a* is positioned such that the arm 38 engages its lever 50 when the biasing portion 30 is in the first position. bottom switch 48*b* is positioned such that the arm 38 disengages the lever 50 of top switch 48*a* and engages the lever 50 of the bottom switch 48*b* when the biasing portion 30 is biased into the second position. By switching electrical connection between contacts, the switches 48 are adapted to transmit a signal indicating whether the actuator 52 of each sensor is depressed or released to indicate the position of the biasing portion 30 and ultimately whether the TPV device 10 has been tripped. In an embodiment, the arm 38 can further comprise at least one protrusion 54 for engaging the level 50 of one of the switches 48.

The claimed invention is also directed to a method for protecting a protected electrical circuit 12 comprising providing a TPV device 10 having a first conducting terminal 20, a second conducting terminal 22 having an MOV assembly 56 and a biasing assembly 24, wherein the first and second conducting terminals 20, 22 are releasably connected by a thermally sensitive material 44. The method further comprises inserting the TPV 10 into the electrical circuit 12 such that the contacted first and second terminals 20, 22 define a portion of the electrical circuit 12. The method can also comprise transitioning the thermally sensitive material 44 into a liquid state in response to temperature increase in the MOV assembly 56 caused by an overvoltage exceeding the rating of the MOV assembly 56 and biasing the first terminal 22 in response to the tension force applied by the biasing assembly 24.

Referring to FIGS. 5A to 8, another embodiment of a thermally-protective varistor (TPV) device 100 is depicted. TPV device 100 is substantially similar to TPV device 10 with some exceptions, including differences in the MOV assemblies, the biased first conducting terminal, and the contact methods and structures between the MOV assembly and the biased conducting terminal.

Figure 5A:
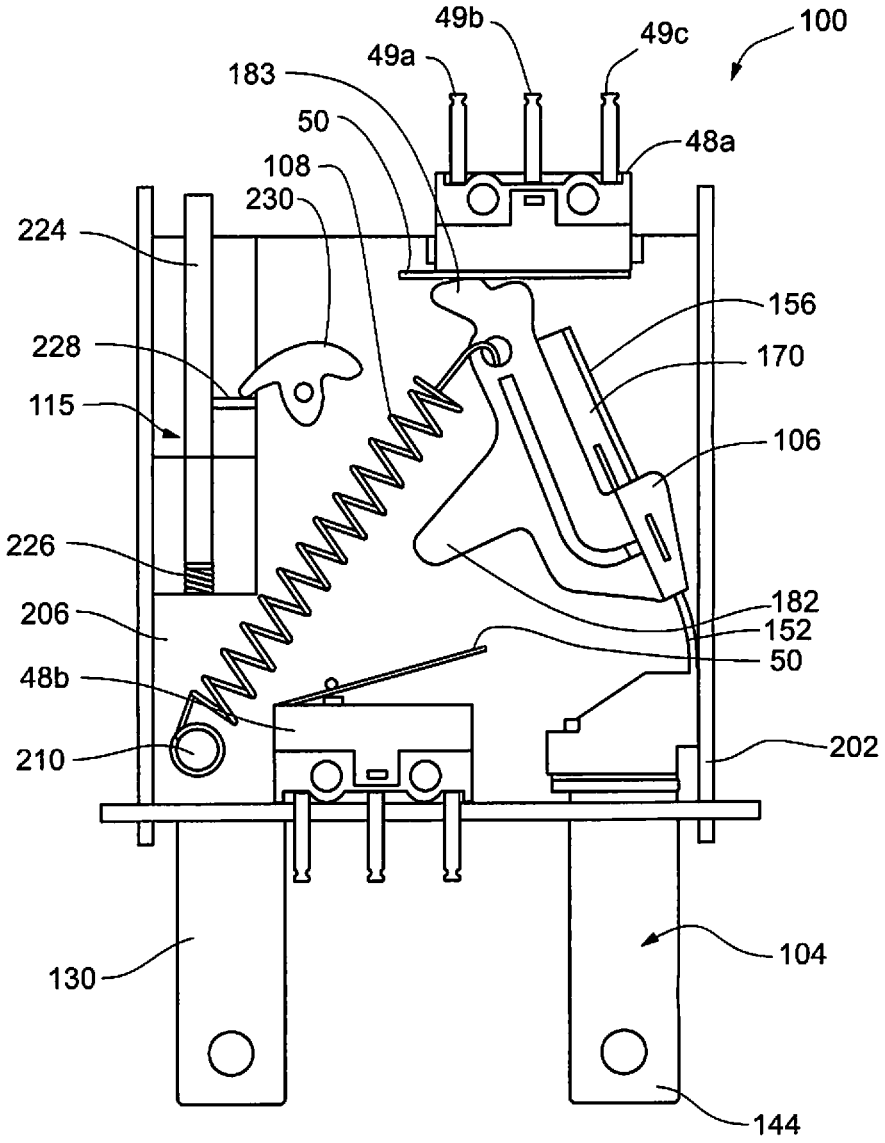
FIG. 5A is front view of another embodiment of a TPV device, the TPV device being in a first, conducting position.
Figure 5B:
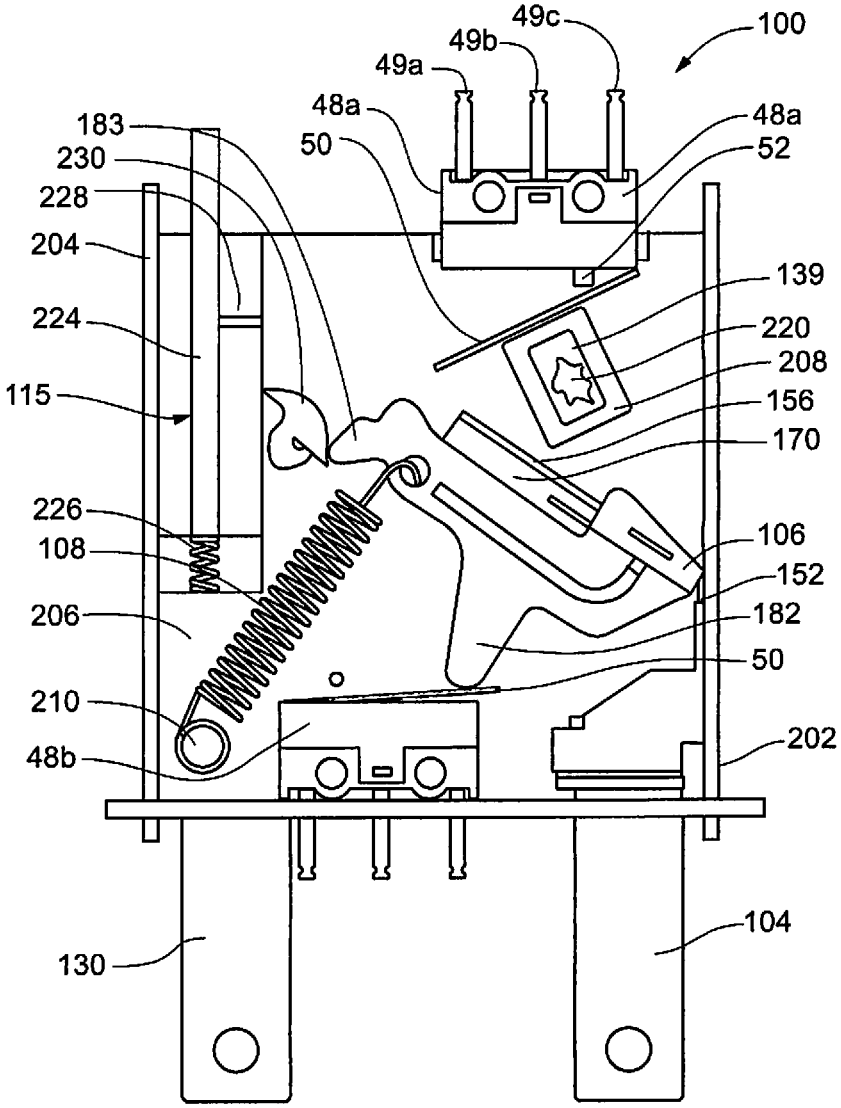
FIG. 5B is a front view of the TPV device of FIG. 5A, the TPV device being in a second, non-conducting position.

Referring to FIGS. 5A and 5B, a front view of TPV 100 in a first, conducting or closed, position is depicted in FIG. 5A, while a front view of TPV 100 in a second, non-conducting or open, position is depicted in FIG. 5B.

Figure 6:
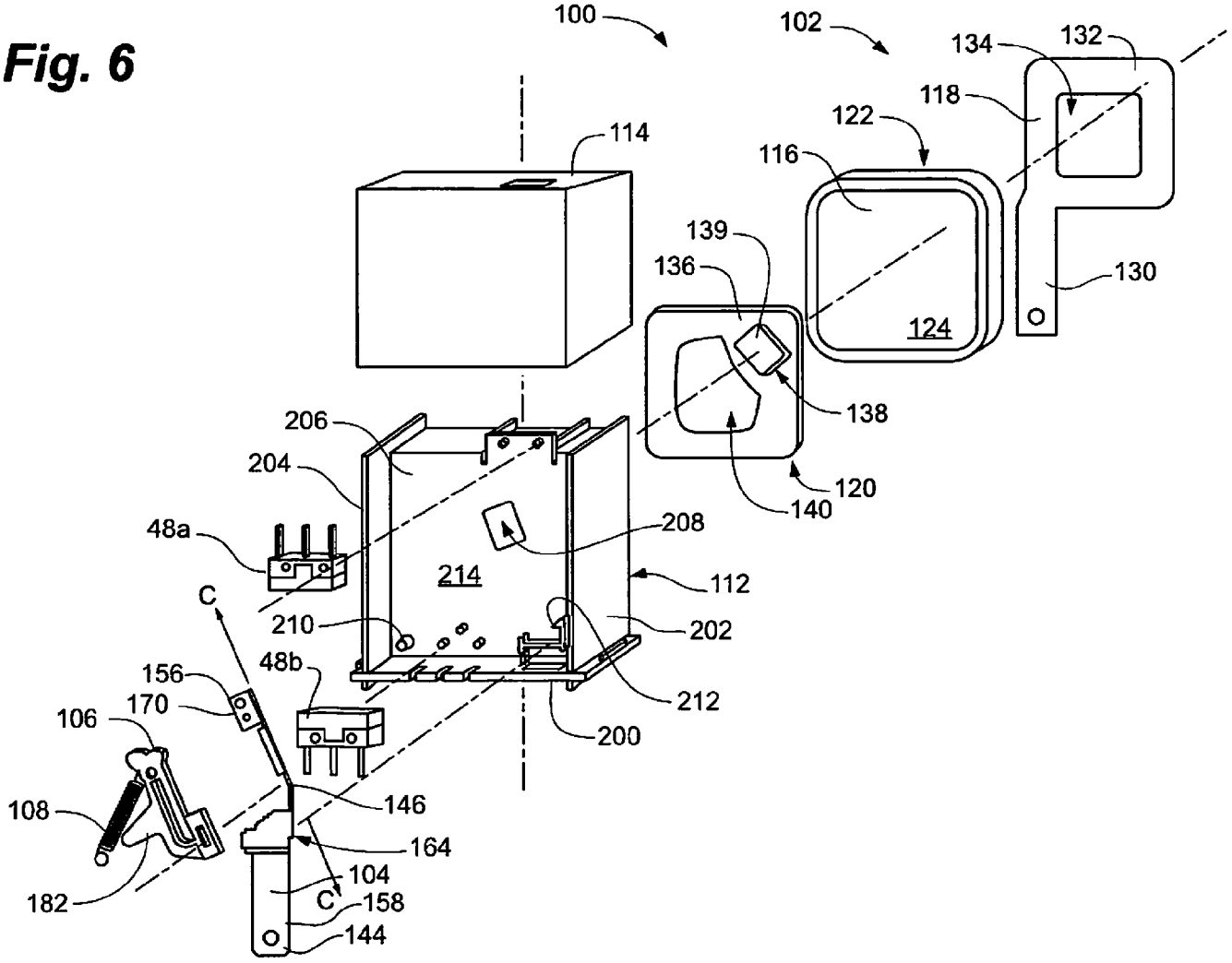
FIG. 6 is an exploded view of the TPV device of FIGS. 5A and 5B.

Referring also to FIG. 6, an exploded view of TPV device 100 is depicted. TPV device 100 includes varistor portion 102, first conducting terminal 104, actuating arm 106, biasing spring 108, optional top switch 48*a*, optional bottom switch 48*b*, frame 112, and enclosure 114. In an embodiment, TPV 100 may also include flag mechanism 115 (see FIGS. 5A and 5B).

Varistor portion 102 includes voltage-sensitive body 116, first lead frame 118 and second lead frame 120.

Voltage-sensitive body 116 comprises first planar surface 122 and second planar surface 124. In an embodiment, second planar surface 124 is generally opposite and parallel first planar surface 122. Voltage-sensitive body 116 in an embodiment comprises a metal-oxide material such as that described above with respect to voltage-sensitive body 58. In such an embodiment, varistor portion 102 comprises a metal-oxide varistor (MOV).

First lead frame 118 in the depicted embodiment comprises first end or extension 130 and contiguous portion 132. In an embodiment, contiguous portion 132 is ring-like and defines opening 134. Contiguous portion 132 and extension 130 may be generally flat and coplanar. In an alternate embodiment, extension 130 is offset from contiguous portion 132 such that portion 132 and extension 130 define parallel planes. First lead frame 118 comprises an electrically-conductive material, such as a metal material.

Second lead frame 120 also comprises an electrically-conductive material, and includes contiguous portion 136 and raised pad 138. Contiguous portion 136 may also be ring-like in shape and define opening 140. Second lead frame 120, with the exception of raised pad 138, may be generally planar as depicted.

Raised pad 138 projects generally outward and away from contiguous portion 136, and includes pad surface 139, which in an embodiment defines a plane parallel to a plane formed by contiguous portion 136. Raised pad 138 may be integral to second lead frame 120, or may comprise a separate body attached to contiguous portion 136. In an embodiment raised pad 138 comprises a rectangular shape, though raised pad 138 may comprise other shapes.

When assembled into TPV device 100, an inner surface of first lead frame 118 is adjacent and in contact with first surface 122 of voltage-sensitive body 116, while an inner surface of second lead frame 120 is adjacent and in contact with second surface 124 of voltage-sensitive body 116.

Figure 7A:
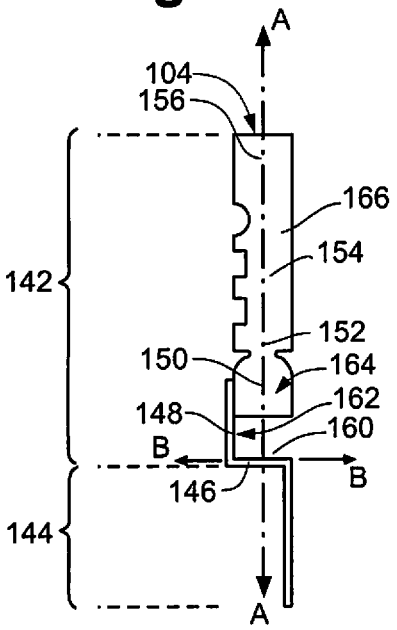
FIG. 7A is a front view of a first conducting terminal of the TPV device of FIGS. 5A-6, according to an embodiment of the claimed invention.
Figure 7B:
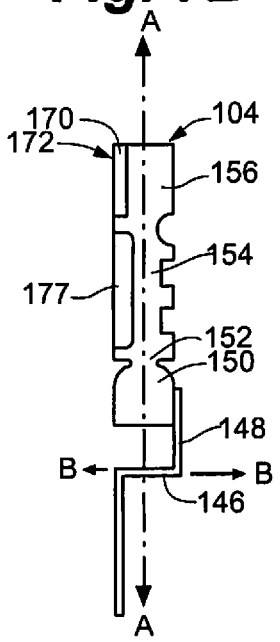
FIG. 7B is a rear view of the first conducting terminal of FIG. 7A.
Figure 7C:
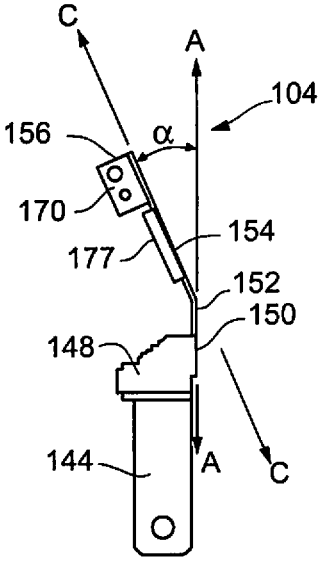
FIG. 7C is a left-side view of the first conducting terminal of FIGS. 7A and 7B.

Referring also to FIGS. 7A to 7C, first conducting terminal 104 includes internal portion 142 and external portion 144. In an embodiment, internal portion 142 is generally housed within frame 112 and enclosure 114, while external portion 144 is generally outside frame 112 and enclosure 114. In an embodiment, first conducting terminal 104 is a contiguous, electrically-conductive terminal, though in other embodiments, first conducting terminal 104 may comprise separate components.

Internal portion 142 of first conducting terminal 104 includes first lower portion 146, second lower portion 148, first central portion 150, bending region 152, second central portion 154, and end portion 156.

External portion 144 extends generally downward and away from frame 112, along an axis parallel to Axis A. External portion 144 includes surface 158 defining an external end plane. External portion 144 bends and transitions to meet first lower portion 146.

First lower portion 146 extends generally along Axis B. First lower portion may be generally planar, defining a surface 160, which defines a first lower plane that includes Axis B. The first lower plane may be generally orthogonal to the external end plane defined by external portion 144.

Second lower portion 148 extends generally upward and away from first lower portion 146 along an axis generally parallel to Axis A. Second lower portion 148 defines surface 160 which defines a second lower plane which is orthogonal to the first lower plane defined by surface 160 and is generally parallel to the external plane formed by surface 158 of external portion 144. It will be understood that in other embodiments, the planar surfaces may not be constrained to defining orthogonal and parallel planes. Second lower portion 148 connects to first central portion 150.

First central portion 150 may comprise a generally flat planar region that defines surface 164 that in turn defines a first central plane that includes Axis A. The first central plane may be generally orthogonal to the external plane and the second lower portion plane, and generally orthogonal to the first lower portion plane. First central portion 150 transitions to second central portion 154 at bending region 152.

Second central portion 154 may also comprise a generally flat planar region, and defines surface 166. In an embodiment, second central portion 154 may also include a ridge 177 that contacts arm 106. Surface 166 defines a second central plane which includes Axis C. Second central portion 150 may bend away from first central portion 150 at bending region 152, such that Axis A and Axis C form an angle α.

In an embodiment, and when first conducting terminal 104 is at rest, or in a first position as depicted in FIG. 5A, angle α may be less than 45°; in an embodiment, angle α may range from 15° to 45° when first conducting element 104; in an embodiment, angle α may range from 30 to 45°. It will be understood that angle α may vary generally so as to allow end 156 to align with raised pad 138 to assume the first position, a conducting position, as depicted in FIG. 5A, and as will be discussed further below.

Second central portion 154 may be integral with end portion 156, such that surface 166 extends to the end of end portion 156.

End portion 156 includes lead-frame contact portion 170. Lead-frame contact portion 170 may comprise a generally flat, planar region that defines lead-frame contact surface 172. Lead-frame contact surface 172 defines a contact plane that is generally parallel to the external plane of the external portion, and may be coplanar with the plane formed by second central portion 148. As such, the contact plane may also be generally orthogonal to the second central plane. When assembled, lead frame contact surface 172 is in contact with raised pad 138 of lead frame 120. In an embodiment, a plane defined by pad surface 139 of raised pad 138 is generally parallel to a plane defined by lead-frame contact portion 170.

In an embodiment, lead frame contact surface 172 has an area that is approximately equal to an area of surface 139 of raised pad 138.

Lead-frame contact portion 170 may define one or more through-holes 174 for improving connectivity between lead-frame contact portion 170 and raised pad 139, which will be discussed further below.

First conducting terminal 104 generally comprises an electrically conductive material, such as a metal material, so that external end 144 is in electrical contact with internal end 142. In an embodiment, first conducting terminal 104 is an integrated, or contiguous, terminal.

Figure 8:
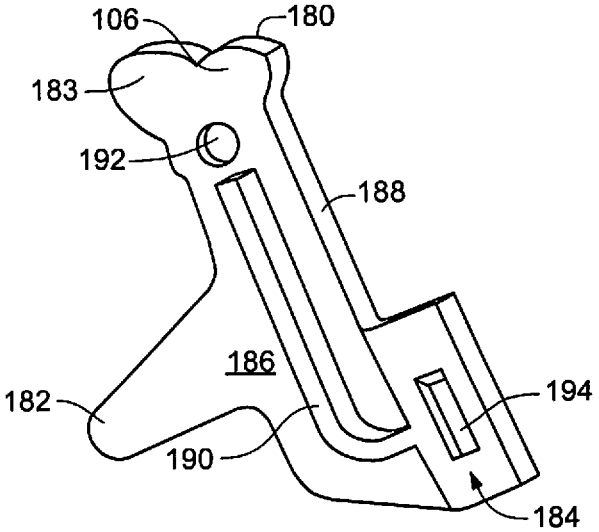
FIG. 8 is a front, perspective view of an actuating arm of the TPV device of FIGS. 5A-6.

Referring also to FIG. 8, actuating arm 106 in an embodiment comprises a non-conductive material, such as a plastic material. As depicted, actuating arm 106 includes top-switch actuating projection ("top projection") 180, bottom-switch-actuating projection ("bottom projection") 182, optional flag actuating projection 183, base portion 184, front surface 186 and side surface 188. Actuating arm 106 may also include support ridge 190 projecting outward and away from front surface 186. Actuating arm 106 may also define spring hole 192 and terminal notch receiving hole 194.

Actuating arm 106 is connected to first conducting terminal 104. In an embodiment, actuating arm 106 may be connected to first conducting terminal 104 by snap or friction fit, may be glued to terminal 104, or otherwise connected.

Referring again to FIGS. 5A, 5B, and 6, spring 108 in an embodiment comprises a coiled, helical, or other such spring. In other embodiments, spring 108 may comprise an alternate elastic member other than a spring. Spring 108 is attached to arm 106 at hole 192 and to frame 112 so as to bias arm 106 and first conducting terminal 104. Top switch 48*a* and bottom switch 48*b* are substantially the same as switches 48*a* and 48*b* described above with respect to the embodiment of TPV device 10.

Frame 112 comprises a generally non-conductive material, and in an embodiment includes bottom wall 200, right side wall 202, left-side wall 204 and center wall 206. Center wall 206 defines raised pad opening 208, and may include multiple projections for engaging and supporting switches 48*a* and 48*b*, first conducting terminal 104, and spring 108, including spring anchor projection 210 and terminal support projection 212. Center wall 206 also defines surface 214.

Enclosure 114 may be fit over frame 112 when assembled to cover and enclose the various components of TPV 100.

When assembled, varistor portion 102 is adjacent a surface of center wall 206, such that raised pad 138 of lead frame 120 projects at least in part through raised pad opening 208 of center wall 206. Switches 48*a* and 48*b* and first conducting terminal 104 are affixed to frame 112 with external end portion 144 extending downward, through, and away from bottom wall 200, thereby firmly securing the switches and the terminal.

Referring specifically to FIG. 5B, TPV 100 also includes temperature-sensitive fusible material 220. Fusible material 220 may comprise a fusible metal alloy, such as solder, that melts when heated. In an embodiment, fusible material 220 may have a melting point ranging from 130° C. to 175° C., though in other embodiments, fusible material 220 may comprise a different melting range point depending in part on the properties of varistor body 116, as well as other characteristics of varistor portion 102. Temperature-sensitive, fusible material 220 is used to attach end portion 156 with portion 170 to raised pad 138.

Referring to FIGS. 5A and 5B, TPV 100 may also include optional flag mechanism 115. In an embodiment, flag mechanism 115 includes rocker arm 230 pivotably mounted to center wall 206 of frame 112, flag 224, and biasing element 226. Biasing element 226 may comprise a spring. Flag 224 may include catch lever 228 in contact with rocker arm 230. In other embodiments, catch lever 228 may not be integral to flag 224. In a first position, flag mechanism 115 maintains flag 224 in a lowered position via rocker arm 230. In a second position, as depicted in FIG. 5B, rocker arm 230 is not in contact with flag 224 after rocker arm 230 is contacted and pivoted by flag-actuating projection 183 and catch lever 228, such that flag 224 is in a raised position. As will be described further below, when flag 224 is in a raised position, first conducting terminal 104 is no longer in electrical communication with lead frame 120 and terminal 130, such that TPV device 100 is no longer conducting electrical current.

Referring specifically to FIG. 5A, TPV 100 is in a first, conducting position. In this position, lead-frame contact portion 170 of first conducting terminal 104, and its contact surface 172 are adjacent pad surface 139 of raised pad 138, held in place by fusible material 220. Spring 108 biases arm 106 and end 156 of first conducting terminal 104 with a force directed generally toward bottom wall 200 and to a certain extent left wall 204. The direction of the force generally lies in a plane parallel to the plane formed by center wall 206 of frame 112.

In this first position, an electrical path is formed through first conducting terminal 104, fusible material 220, second lead frame 120, varistor body 124, first lead frame 118, such that end 144 and end 130 are in electrical connection, and current may flow through TPV 100.

During normal operation, or no overvoltage condition, while varistor body 124 emits some heat, the heat is at a low enough level such that fusible material 220 maintains a solid state, maintaining lead-frame contact portion 170 of first conducting terminal 104 in electrical contact with raised pad 138 of second lead frame 120.

During an overvoltage situation, the temperature of varistor body 124 of voltage-sensitive assembly 102 rises quickly. As the temperature rises, those elements in contact with varistor body 124 conduct heat. Heat is conducted along a thermal path from varistor body 124 to second lead frame 120 and its raised pad 138 to fusible material 220 and contact portion 170.

Referring to FIG. 5B, when fusible material 220 nears or reaches its melting point, the force exerted by spring 108 on end 156 of terminal 104 causes end 156 and contact portion 170 to pull away from raised pad 138 in a direction toward bottom wall 200 and left wall 202, in the direction of the pulling force exerted by spring 108. When contact portion 170 is no longer adjacent and in contact with surface 139 of raised pad 138, the electrical connection between contact portion 170 and raised pad 138, and thusly, between first conducting terminal 104 and second lead frame 120 is broken.

As compared to known MOV-based circuit protection devices, TPV device 100 provides faster reaction times due to the shortened thermal path and improved heat transfer capability enabled by the combination of second lead frame 120 and first conducting terminal 104. More specifically, raised pad 138 in contact with lead-frame contact portion 170 of first conducting terminal 104 creates a shorter thermal path as compared to other designs, so that when varistor body 124 heats up due to an overvoltage condition, that heat is more quickly conducted to fusible material 220, causing first conducting terminal 104 to be more quickly released from second lead frame 120. Known lead frames that include standard contact terminals that project perpendicularly away from their respective lead frame, may not conduct heat as quickly, and may be somewhat slower reacting.

If TPV 100 includes flag mechanism 115, projection 183 contacts rocker arm 230, causing flag 224 to be moved to a raised position, thusly signaling that TPV 100 is in a second, or non-conducting, position.

In addition to the devices described above, the claimed invention includes methods of thermally protecting an electrical circuit using a thermally-protected varistor device in electrical connection with the electrical circuit. One such method includes: securing a varistor assembly having a varistor body and a conductive lead frame to a non-conductive frame of a thermally-protected varistor device such that a raised pad of the lead frame projects through an opening in the non-conductive frame; releasably connecting an end portion of a first conducting terminal to the raised pad using a temperature-sensitive, fusible material; and biasing the end portion of the first conducting terminal.

In an embodiment, the method may further comprise aligning a generally flat, planar portion of the end portion of the first conducting terminal with a pad surface of the raised pad, the planar portion of the end portion defining a plane generally parallel with a plan defined by the pad surface. The plane defined by the pad surface may generally be parallel to a plane defined by a range of motion of the first conducting portion and/or may generally be parallel to a center wall of the frame.

Embodiments also may include providing a set of instructions for using the TPV device.

Other embodiments may include biasing a flag of a flag mechanism, wherein the flag indicates that the TPV device is in a first, conducting position when the flag is biased.

Although specific examples have been illustrated and described herein, it will be appreciated by those of ordinary skill in the art that any arrangement calculated to achieve the same purpose could be substituted for the specific examples shown. This application is intended to cover adaptations or variations of the present subject matter. Therefore, it is intended that the invention be defined by the attached claims and their legal equivalents, as well as the following illustrative embodiments.

For purposes of interpreting the claims for the present invention, it is expressly intended that the provisions of Section 112, sixth paragraph of 35 U.S.C. are not to be invoked unless the specific terms "means for" or "step for" are recited in a claim.

The invention claimed is:

1. A thermally-protected varistor (TPV) device, comprising:

a voltage-sensitive body including a first surface and a second surface, the voltage-sensitive body comprising a material that generates heat in response to a voltage potential across the voltage-sensitive body;

a first conductive lead frame adjacent the first surface of the voltage-sensitive body, the first conductive lead frame including a first external end adapted to be electrically connected to an external electrical circuit;

a second conductive lead frame including a first surface and a second surface, the first surface adjacent the second surface of the voltage-sensitive body, the second conductive lead frame including a raised pad projecting outwardly and away from the second surface of the second conductive lead frame;

a first conducting terminal including a terminal end for connecting to the external electrical circuit, and an end portion for contacting the raised pad of the second conductive lead frame when the TPV device is in a first, conducting position;

a first switch actuatable by an actuating are coupled to the first conducting termainal;

a temperature-sensitive fusible material releasably connecting the end portion of the first conducting terminal to the raised pad of the second conductive lead frame when the TPV device is in a first, conducting position;

a biasing element biasing the end portion of the first conducting terminal such that the end portion of the first conducting terminal moves away from the raised pad of the second conductive lead frame when the temperature-sensitive fusible material releases the end portion of the first conducting terminal from the raised pad in response to heat generated by the voltage potential, such that the TPV is in a second, non-conducting position.

2. The TPV device of claim 1, wherein the material of the voltage-sensitive body comprises a metal-oxide material.

3. The TPV device of claim 1, wherein the raised pad includes a pad surface that defines a plane that is substantially parallel to a plane defined by a contact portion of the end portion of the first conducting terminal that is in contact with and adjacent to the raised pad.

4. The TPV device of claim 1, wherein a pad surface of the raised pad defines a plane that is generally parallel to a plane defined by a direction of motion of the end portion of the first terminal when the end portion of the first terminal is released from the raised pad.

5. The TPV device of claim 1, wherein the first conducting terminal includes a first portion defining a first axis, a second portion defining a second axis, and a bending region joining the first portion and the second portion, the first axis and the second axis defining an angle ranging from 30° to 45° when the TPV device is in the first, non-conducting position.

6. The TPV device of claim 5, wherein the angle is greater than 45° degrees when the TPV is in the second, non-conducting position.

7. The TPV device of claim 1, further comprising a flag mechanism, the flag mechanism including a flag biased with a spring, the flag configured to be in a raised position when the TPV device is in a second, non-conducting position.

8. The TPV device of claim 1, the actuating arm receiving an end of the biasing element so as to bias the first conducting terminal.

9. The TPV device of claim 1, wherein the biasing element comprises a coiled spring.

10. The TPV device of claim 1, further comprising a second switch actuatable by the actuating arm.

11. A thermally-protected varistor (TPV) device, comprising:

means for securing a varistor assembly having a varistor body and a conductive lead frame to a non-conductive frame of a thermally-protected varistor device such that a raised pad of the lead frame projects through an opening in the non-conductive frame;

means for releasably connecting an end portion of a first conducting terminal to the raised pad using a temperature-sensitive, fusible material;

means for biasing the end portion of the first conducting terminal; and means for signaling when the thermally-protected varistor device is in a non-conductive position, said means comprising a flag mechanism, the flag mechanism including a flag biased with a spring, the flag moves to a raised position when an end portion of the first conducting terminal moves away from the raised pad when the temperature-sensitive fusible material releases the end portion of the first conducting terminal from the raised pad in response to heat generated by the voltage potential.

* * * * *